US005369253A

United States Patent [19]

Kuwata et al.

[11] Patent Number: 5,369,253

[45] Date of Patent: Nov. 29, 1994

[54] HEATING COOKER

[75] Inventors: Kyoko Kuwata; Sachiko Endo; Koji Murakami; Yukinobu Takahashi; Norisuke Fukuda, all of Tokyo, Japan

[73] Assignee: Kabushiki Kaisha Toshiba, Kawasaki, Japan

[21] Appl. No.: 83,331

[22] Filed: Jun. 29, 1993

Related U.S. Application Data

[63] Continuation of Ser. No. 690,846, Apr. 26, 1991, abandoned.

[30] Foreign Application Priority Data

Apr. 28, 1990 [JP] Japan ..... 2-114389
Jul. 30, 1990 [JP] Japan ..... 2-199144

[51] Int. Cl.[5] ..... H05B 6/50

[52] U.S. Cl. ..... 219/707; 219/708; 219/710; 219/712; 219/704; 219/400; 99/325

[58] Field of Search ..... 219/707, 702, 704, 708, 219/709, 710, 712, 400, 492; 99/325, 330, 333, 468

[56] References Cited

U.S. PATENT DOCUMENTS

| | | | |
|---|---|---|---|
| 4,335,293 | 6/1982 | Kobayashi et al. | 219/10.55 B |
| 4,517,431 | 5/1985 | Ueda | 219/10.55 B |
| 4,582,971 | 4/1986 | Ueda | 219/10.55 B |
| 4,584,448 | 4/1986 | Tanabe | 219/10.55 B |
| 4,692,597 | 9/1987 | Tsuda et al. | 219/10.55 B |
| 4,734,554 | 3/1988 | Tateda et al. | 219/10.55 B |
| 4,754,112 | 6/1988 | Hiroshima | 219/10.55 B |
| 4,814,570 | 3/1989 | Takizaki | 219/10.55 B |
| 4,831,239 | 5/1989 | Ueda | 219/518 |
| 4,833,304 | 5/1989 | Ueda | 219/518 |
| 4,864,088 | 9/1989 | Hiejima et al. | 219/10.55 B |
| 4,920,948 | 5/1990 | Koether et al. | 219/10.55 B |
| 5,015,812 | 5/1991 | Kasai et al. | 219/10.55 B |
| 5,155,339 | 10/1992 | An | 219/492 |

FOREIGN PATENT DOCUMENTS

| | | |
|---|---|---|
| 0024798 | 3/1981 | European Pat. Off. . |
| 0074764 | 3/1983 | European Pat. Off. . |
| 0078607 | 5/1983 | European Pat. Off. . |
| 0238022 | 9/1987 | European Pat. Off. . |
| 0289000 | 11/1988 | European Pat. Off. . |
| 2509108 | 1/1983 | France . |
| 1-239322 | 9/1989 | Japan . |

*Primary Examiner*—Bruce A. Reynolds
*Assistant Examiner*—Tu Hoang
*Attorney, Agent, or Firm*—Foley & Lardner

[57] ABSTRACT

A heating cooker includes a cooking chamber having a heater for heating food, a gas sensor for detecting the quantity of vapor evaporating from the food heated in the cooking chamber, a temperature sensor for detecting a temperature in the cooking chamber, and a controller for determined the kind of the food according to the quantity of vapor detected by the gas sensor, and for controlling the heating temperature and heating time of the heater according to the kind of food which has been determined.

10 Claims, 13 Drawing Sheets

SET TIME, TO BE HEATED AT SET TEMPERATURE OF Tc

<COURSES A AND B>

OUTPUT OF GAS SENSOR $V_1/V_0$ $t_0$: TIME FROM THE START UNTIL THE INSIDE OF COOKER ATTAINS PREDETERMINED TEMPERATURE $T_0$

<COURSE C>

HEATING COOKER

This application is a continuation of application Ser. No. 07/690,846, filed Apr. 26, 1991, now abandoned.

BACKGROUND OF THE INVENTION

1. Field of the Invention

The present invention relates to a heating cooker, and particularly to a technique of automatically baking cakes, etc., with the heating cooker.

2. Description of the Prior Art

A heating cooker such as an electronic oven generally has a grilling function and an oven function. The grilling function is achieved with a flat heater attached to the ceiling of the cooker to cook fish, meat, etc., with radiant heat, while the oven function is achieved with a sirocco fan and a sheathed heater arranged on the back of a heating chamber of the cooker to bake bread, cakes, etc., with hot air circulated in the cooking chamber.

To automatically control the grilling and oven functions, a conventional technique employs a weight sensor. With the weight sensor, the technique measures a total of the weight of food to be cooked and the weight of container of the food, calculates a heating time according to the total weight, and after the elapse of the heating time, automatically stops heating the food. Another conventional technique employs a weight sensor to calculate a base time and a temperature sensor to detect vapor evaporating from heated food and to calculate an additional heating time, from which the technique determines a total heating time.

Food, particularly bread or a cake must be baked under careful control to form air bubble inside it. In automatically baking the bread or the cake, the above conventional techniques raise the following problems:

1) If no preheating is done or if the cooking chamber is not sufficiently cooled, the conventional techniques cannot correctly calculate a heating time of the bread or the cake. After repetitive use of the oven, bread or cakes may be overbaked. Under the increasing need of cooking with no preheating, this problem is serious.

2) The conventional techniques restrict the weight of a container of food to be cooked. Cake molds may be made of stainless steel, heat-resistant glass, aluminum, paper, etc., which have different weight. The weight sensor of the conventional techniques restricts the material of the container. If it is unrestricted, the conventional control techniques may be useless because the weight sensor measures a total of the weight of a mold and the weight of food contained in the mold. Namely, the baking of bread or a cake is greatly influenced by the weight of a mold to be used for baking the bread or the cake. If the mold is light weight, a baking time may become shorter to make the bread or the cake half-baked.

3) The weight sensor must be connected with a top plate of the cooker. This arrangement limits the size of the top plate so that a space in the cooking chamber may not effectively be used. Compared with a usual square top plate, the top plate of the above techniques must have limited size and shape which may reduce the quantity of food to be cooked on the top plate. It is possible to employ a special top plate, but it may increase the number of accessories and the cost and deteriorate handling convenience of the cooker.

4) The control means employed by the above techniques includes only the weight sensor. This limits a base time for each menu. This means that a menu which is selected with one selection key of the cooker does not have flexibility in cooking times. For example, there are various kinds of cakes such as sponge cakes, pound cakes, madeleines, and roll cakes. The automatic control of the conventional techniques, however, cannot deal with a variety of these cakes because they involve different heating times.

Thus, the conventional automatic cooking techniques for the heating cooker, such as the electronic oven employing the weight sensor, have the problems of setting an improper heating time for repetitive use, limiting the size of the top plate of the cooker to spoil effective use of space in the cooking chamber, being influenced by the weight of a container for the food to be cooked, and limiting the flexibility of cooking time for each menu.

SUMMARY OF THE INVENTION

To solve the above problems, an object of the invention is to provide a heating cooker which can deal with various menus using a single automatic cooking key and can achieve stabilized cooking even when no preheating is used (insert 2) repetitive heating is utilized.

Another object of the invention is to provide a heating cooker which can 1) cook a variety of menus such as for different baking cakes using one automatic cooking key, 2) accurately identify the kind of a cake to be baked, and 3) properly bake the cake.

Still another object of the invention is to provide an electronic oven which detects the concentration of a gas or vapor evaporating from heated food such as a cake, as well as a change in the concentration of the gas to determine the kind of cake, and according to the determined kind, controls a heater to automatically bake the cake.

In order to accomplish the above objects, a heating cooker according to a first aspect of the invention includes a gas sensor for detecting vapor evaporating from food heated in a cooking chamber of the cooker, and a temperature sensor for detecting a temperature in the cooking chamber. Based on the outputs of these sensors, a heater is controlled to maintain a set temperature in the cooking chamber. The quantity of vapor evaporating from the food detected by the gas sensor determines the kind of food to be cooked, and the food is automatically cooked according to the determined kind.

The surface area of the food to be cooked greatly influences the quantity of vapor evaporating from the food as well as the heating time of the food. For example, to make a roll cake, dough is poured large and thick onto a top plate of the cooker, is baked, and then rolled into a roll. On the other hand, to make a sponge cake or a pound cake, dough is poured thick into a mold and baked. A thin cake such as the roll cake having a large surface area must be baked in a short time at a high temperature, while a thick cake such as the pound cake having a small surface area must be baked in a longer time longer at a low temperature.

The first aspect of the invention satisfies these requirements. The heating cooker according to the first aspect of the invention detects the surface area of food to be cooked from the quantity of vapor evaporating from the food, and determines the heating conditions of the food according to the detected surface area.

The first aspect of the invention controls the heated of the cooker to maintain a set temperature in the cooking chamber, detects the quantity of vapor evaporating from food to be cooked, determines the kind of the food according to the vapor quantity, and calculates additional heating time and temperature according to the determined kind of the food, thereby automatically cooking the food. This aspect of the invention precisely controls with a control key to properly cook food.

The cooker of this aspect of the invention involves weight sensor, and therefore, improves the degree of freedom of designing and increase a cooking space in the cooker.

A heating cooker according to a second aspect of the invention comprises a gas sensor for detecting vapor evaporating from food heated in a cooking chamber of the cooker, and a temperature sensor for detecting a temperature around the gas sensor. These sensors detect a temperature in the cooking chamber at the start of a time necessary for attaining a predetermined temperature, and the quantity of vapor evaporating from the food to be cooked. The quantity of vapor is corrected according to the temperature in the cooking chamber at the start of cooking and the time necessary for attaining the predetermined temperature. Based on the corrected vapor quantity, an additional heating time is calculated to automatically cook the food.

The second aspect of the invention corrects the vapor quantity detected by the gas sensor according to the temperature around the gas sensor at the start of cooking, thereby properly cooking the food even under repetitive heating or even if the inside of the cooking chamber is not sufficiently cooled. In this way, the second aspect of the invention can better control cooking depending on food to be cooked.

A temperature at which the gas sensor detects the quantity of vapor is preferable to be a lowest cooking temperature. Once this lowest cooking temperature is attained, a heating time and a heating temperature that follow will be determined to cook food properly and efficiently.

A heating cooker according to a third aspect of the invention comprises a cooking chamber for cooking food with heat generated by a heater, a gas sensor for detecting a gas or vapor evaporating from the food heated in the cooking chamber, a temperature sensor for detecting a temperature in the cooking chamber, a controller for controlling the heater, and a judging unit for determining the kind of the food according to outputs of the gas sensor and thereby determining a cooking temperature and a cooking time, the controller measures an output V1 of the gas sensor after the cooking chamber attains a set temperature which is lower than a lowest cooking temperature determined by the kind of the food. The controller then heats the food for a set time at a temperature t2, calculates a difference (V1–V2) between the output value V1 and another output V2 of the gas sensor detected thereafter, finds the volume of the food from the values V1 and (V1–V2) to judge the kind of the food, determines a cooking temperature and a cooking time according to the judged kind, and heats the food at the determined temperature for the determined time.

As explained before, the quantity of vapor evaporating from food to be cooked is greatly influenced by the surface area of the food. Also, a heating time of the food is influenced by the surface area and volume of the food.

A large surface area is equivalent to a large evaporating area to which easily produces vapor. If a cake to be baked with the cooker has a large surface area, it produces a large quantity of vapor initially. If the volume of a cake is large, it continuously produces vapor until it is baked to some extent. The larger the volume of a cake, the larger a change occurring in the quantity of vapor evaporating from the cake.

A roll cake and a sponge cake are made from substantially the same ratio of ingredients of egg flour, sugar, and butter which are mixed together but baked in different shapes. Namely, to make the roll cake, the materials are poured thin onto a top plate of the cooker, baked, and rolled into a roll. On the other hand, to make the sponge cake, the materials are poured thick into a baking mold and baked.

The roll cake has a large surface area and is thin so that it has a large evaporating area to easily produce vapor. The roll cake, therefore, produces a large quantity of vapor at first and is baked in a short time, so that the quantity of vapor from the roll cake may decrease quickly after a certain time and arrive at a constant value. This means that the quantity of vapor from the roll cake changes in a very short arrive at. This sort of cake having a large surface area and being thin, must be baked at a high temperature time.

On the other hand, the sponge cake has a small surface area and is thick so that it takes a relatively long time to bake, and the quantity of vapor evaporating from the sponge cake changes more smoothly. Accordingly, it produces a small quantity of vapor at first. After that, the quantity of vapor changes widely. This sort of cake having a small surface area and being thick must be baked in a long period of time.

Compared with the sponge and roll cakes, a pound cake uses more butter and is made from a different ratio of ingredients. This difference in the ingredients, however, can be substantially ignored when measuring the quantity vapor. Namely, baking conditions of the pound cake are largely influenced by its shape and size.

In view of these points, the third aspect of the invention detects the surface area of food to be cooked with the cooker according to the quantity of vapor evaporating from the food at a predetermined temperature, detects the volume of the food according to a change in the quantity of vapor, and precisely determines heating conditions of the food according to the obtained data..

Since the third aspect of the invention detects the quantity of vapor at different occasions, it can correctly judge the kind of a cake to be baked even if the quantity of vapor fluctuates; and can bake the cake depending on the shape and size of a mold of the cake.

These and other objects, features and advantages of the invention will be more apparent from the following detailed description of preferred embodiments in conjunction with the accompanying drawings.

DETAILED DESCRIPTION OF THE EMBODIMENTS

Figure 1:
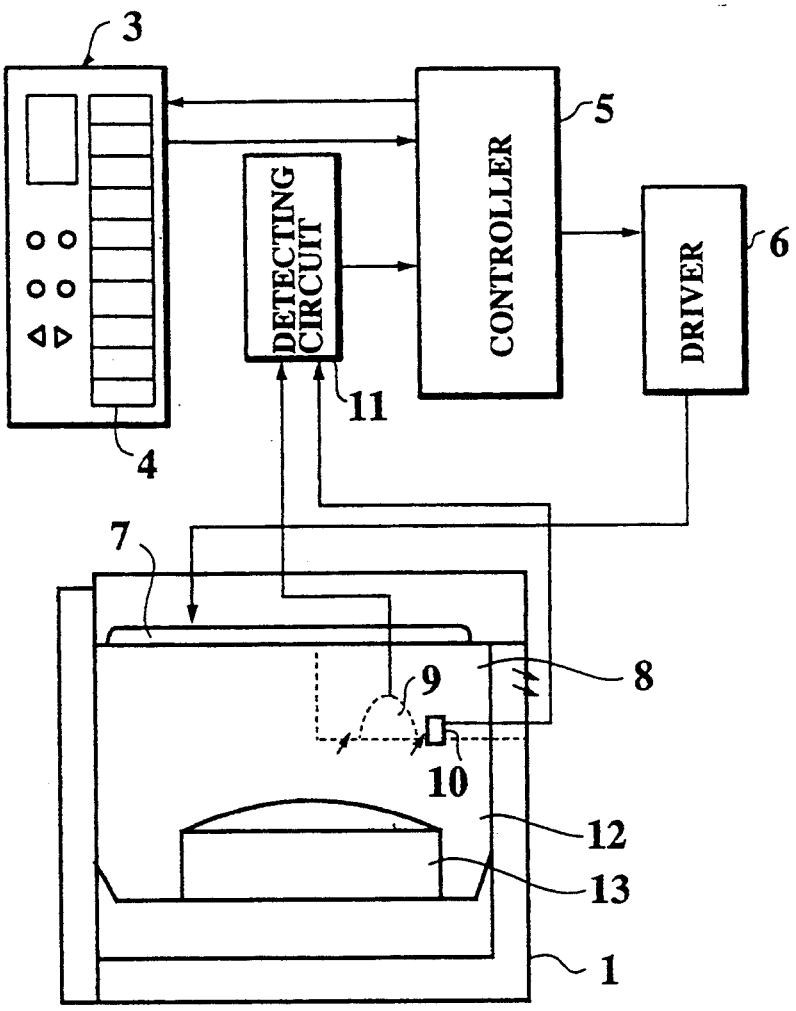
FIGS. 1 and 2 are schematic views showing an electronic oven according to a first embodiment of the invention.
Figure 2:
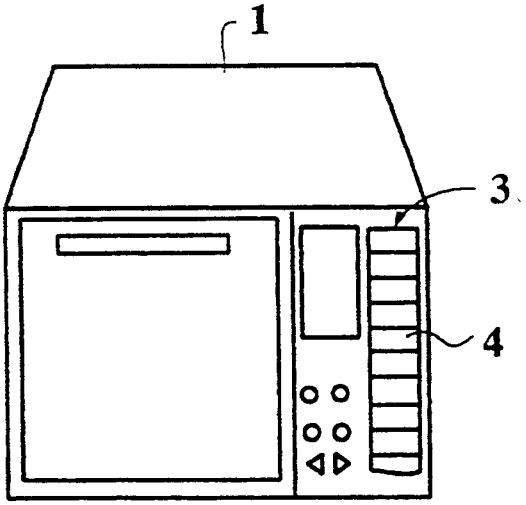

FIGS. 1 and 2 are views showing a heating cooker, i.e., an electronic oven according to the first embodiment of the invention, in which FIG. 2 is a perspective view. The electronic oven (heating cooker) includes a cabinet 1 and a vertically opening door 2 fitted to the cabinet 1. The cabinet 1 defines a cooking chamber 12 which includes a heater 7 fitted to the ceiling of the chamber. A control panel 3 is arranged on the use of side of the door 2. Auto-keys 4 are arranged on the operation panel 3. A user may select and automatically cook a required menu through the auto-keys 4.

An automatic cooking instruction entered through the auto-keys 4 is decoded by a controller 5. A driver 6 supplies electricity to the heater 7. An exhaust duct 8 is disposed inside the cabinet 1. In the exhaust duct 8, there are arranged a gas sensor 9 for detecting vapor evaporating from food 13 which is heated in the cooking chamber 12, and a temperature sensor 10 for detecting a temperature around the gas sensor 9. A detecting circuit 11 detects a temperature in the cooking chamber 12 at the start of cooking, a time necessary for attaining a predetermined temperature, and the quantity of vapor evaporating from the food 13 when the predetermined temperature is attained. The controller 5 corrects the quantity of vapor detected when the predetermined temperature is attained according to the temperature in the cooking chamber 12 detected at the start of cooking, and calculates an additional heating time according to the corrected value.

Based on the information detected through the temperature sensor 10, the controller 5 keeps the temperature inside the cooking chamber 12 constant, and automatically terminates the heating of the food 13 after the additional heating time.

Figure 3:
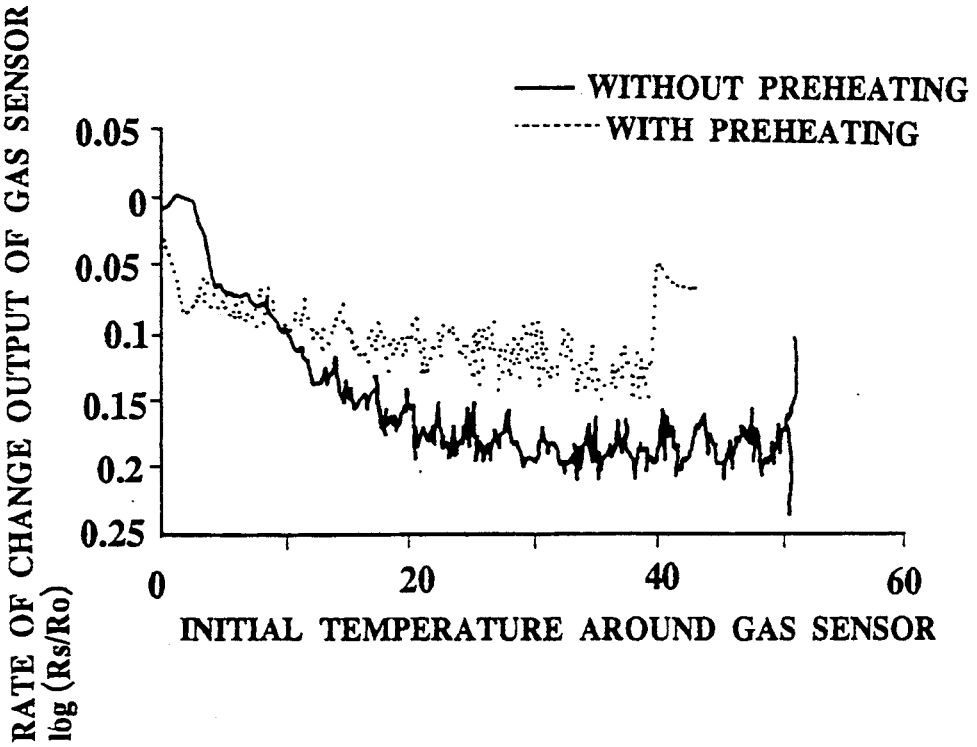
FIG. 3 is a view showing a rate of change of outputs of a gas sensor of the oven in baking sponge cakes with different initial temperatures in a cooking chamber of the oven.

FIG. 3 shows a rate of change of outputs of the gas sensor 9 in baking sponge cakes with different initial temperatures in the cooking chamber 12. In the figure, an abscissa represents a heating time, and an ordinate indicates the rate of change of outputs of the gas sensor 9. This rate is based on outputs of the gas sensor 9 measured when the temperature in the cooking chamber 12 reaches 160° C. As shown in FIG. 3, when an initial temperature in the cooking chamber 12 is high, the rate of change of the outputs of the gas sensor 9 is large. It is understood from this that the gas sensor 9 is temperature dependent.

Figure 4:
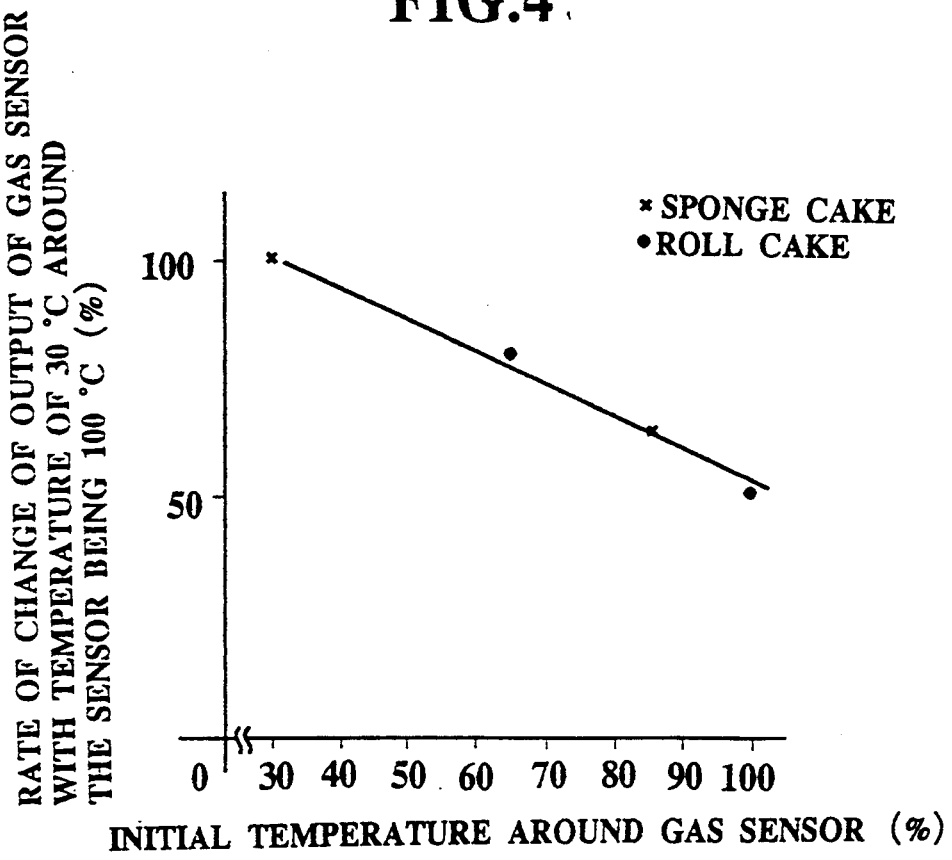
FIG. 4 is a view showing a rate of change of outputs of the gas sensor in baking cakes with no preheating.

FIG. 4 shows a rate of change of outputs of the gas sensor 9 with respect to different initial temperatures, in which a temperature of about 30° C. around the gas sensor 9 with no preheating is set as 100.

Figure 5:
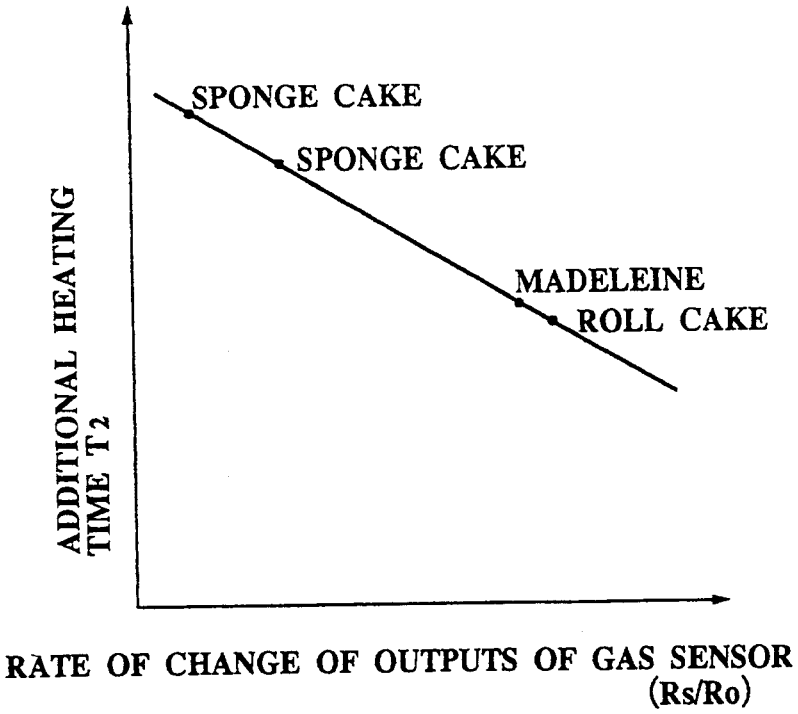
FIG. 5 is a view showing a rate of change of outputs of the gas sensor and an additional heating time after the cooking chamber has attained 160° C. in baking various cakes.

FIG. 5 shows a rate of change of outputs of the gas sensor 9 and an additional heating time after the cooking chamber 12 attains 160° C. in baking various cakes such as pound cakes, sponge cakes, madeleines, and roll cakes.

Figure 6:
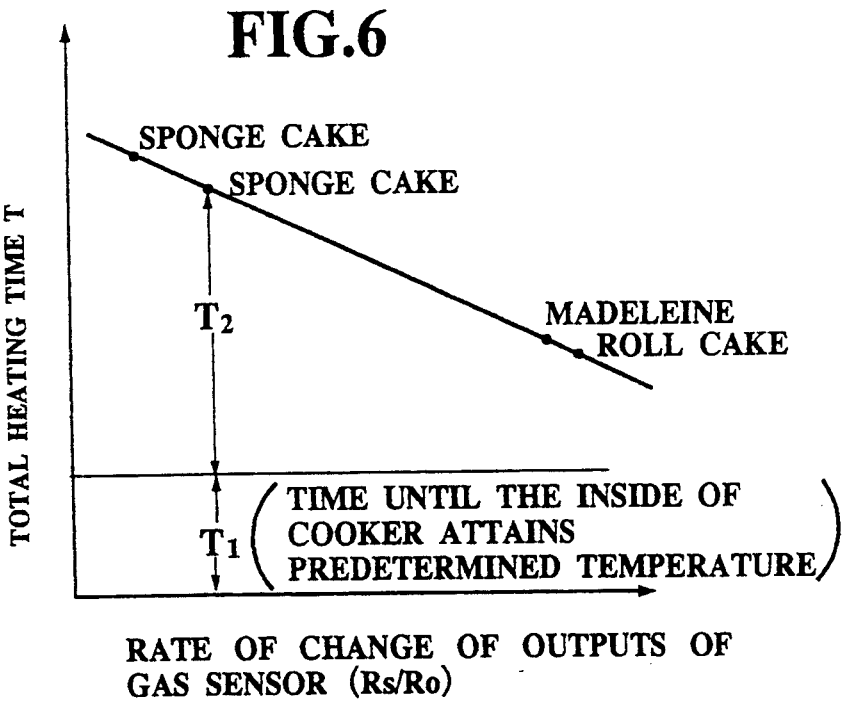
FIG. 6 is a view showing a relationship between a total heating time T and a rate of change of outputs of the gas sensor.

FIG. 6 is based on FIG. 5 and shows a relationship between a total heating time T and the rate of change of outputs of the gas sensor 9 in baking the various cakes such as the pound cakes, sponge cakes, madeleines, and roll cakes.

Figure 7:
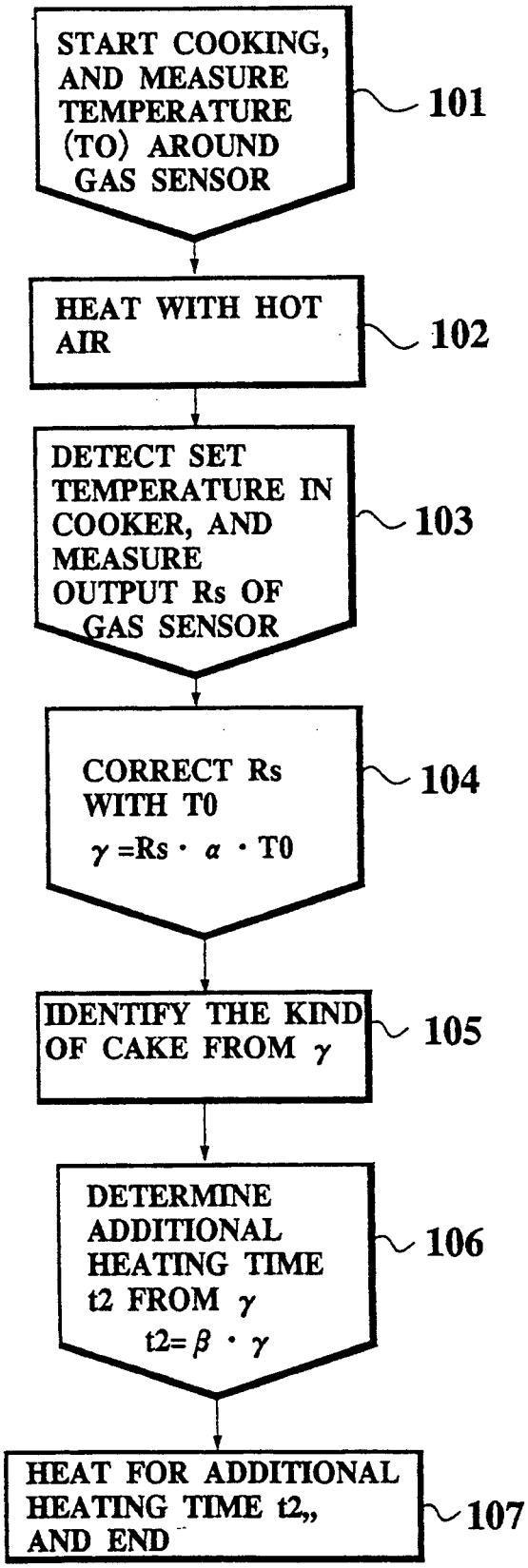
FIG. 7 is a flowchart showing an operation of the first embodiment.

Baking a sponge cake with use of the electronic oven (heating cooker) of the first embodiment will be explained with reference to a flowchart of FIG. 7.

Materials of the sponge cake are kneaded and poured into a baking mold. The mold is placed in the oven. A user pushes one of the auto-keys 4 on the control panel 3 in front of the cabinet 1, and pushes a start button to energize the heater 7. Before the energization of the heater 7, the temperature sensor 10 measures a temperature T0. (Measuring step 101)

Heating starts. (Heating step 102)

When the temperature sensor 10 measures 160° C. the gas sensor 9 provides an output Rs. (Measuring step 103)

The output Rs is corrected with the heating start temperature T0 to calculate a corrected value of $\gamma = Rs\alpha TO$ where $\alpha$ is a constant. (Correcting step 104)

Based on the corrected value $\gamma$, the kind of the cake is identified. (Identifying step 105)

An additional heating time $T2 = \beta\gamma$($\beta$ being a constant) is determined according to the corrected value $\gamma$. (Additional heating time determining step 106)

The additional heating time T2 is informed to the driver 6 to additionally energize the heater 7, thereby completing the baking of the cake. (Additional heating step 107)

In this way, the cake is automatically baked under good controllability. Even if an initial condition in the cooking chamber 12 differs or the chamber is repeatedly heated, a heating time is automatically corrected to cook food optimally. The cooker of the first embodiment can automatically cook food irrespective of the kind of a container and the materials of the food, and optimally correct a heating time for different menus to cook various menus.

The second embodiment of the invention will be explained.

Figure 8:
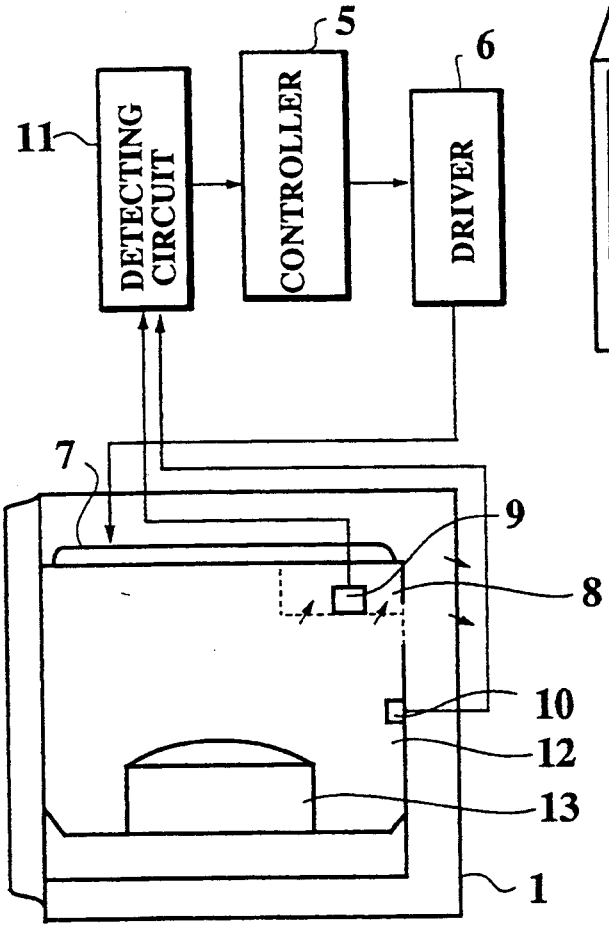
FIGS. 8 and 9 are views showing an electronic oven according to a second embodiment of the invention.
Figure 9:
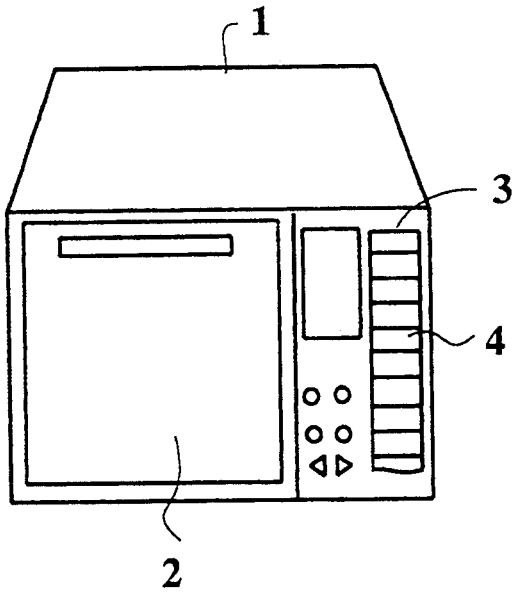

FIGS. 8 and 9 show an electronic oven (heating cooker) according to the second embodiment of the invention, in which FIG. 9 is a perspective view. This electronic oven is basically the same as that of the first embodiment. A temperature sensor 10 for detecting a temperature in a cooking chamber 12 is disposed, however, in the vicinity of food 13 instead of in the vicinity of a gas sensor 9. An output of a heater 7 is controlled according to a value detected by the temperature sensor 10 to keep a temperature in the cooking chamber 12 at a set temperature. The gas sensor 9 detects vapor evaporating from the food 13 heated in the cooking chamber 12 to measure the quantity of the vapor from the food 13. According to the quantity of the vapor, the kind of the food 13 is determined, and according to the determined kind, an additional heating time and a heating temperature are determined to automatically cook the food 13.

Similar to the first embodiment, the electronic oven (heating cooker) comprises a cabinet 1 and a vertically opening door 2 fitted to the cabinet 1. The cabinet 1 defines the cooking chamber 12 having the heater 7 attached to the ceiling. A control panel 3 is arranged on the side of the door 2, and auto-keys 4 on the control panel 3. A user can select and automatically cook a required menu through the auto-keys 4.

An automatic cooking instruction entered through the auto-keys 4 is decoded by a controller 5. A driver 6 supplies electricity to the heater 7. An exhaust duct is disposed in the cabinet 1. Inside the exhaust duct 8, there is arranged the gas sensor 9 for detecting vapor evaporating from the food 13 being heated in the cooking chamber 12. The temperature sensor 10 detects a temperature around the food 13 in the cooking chamber 12. A detecting circuit 11 detects a temperature in the cooking chamber 12 at the start of cooking, a first quantity of vapor evaporating from the food 13 at the start of cooking, a time necessary for attaining a predetermined temperature, and a second quantity of vapor evaporating from the food 13 when the predetermined temperature is attained. Based on the first and second vapor quantities, the controller 5 finds a rate of change of the vapor quantities, identifies the kind of the food according to the rate of change, and determines an additional heating time and a heating temperature for the heater 7 accordingly.

According to the information detected by the temperature sensor 10, the controller 5 keeps a temperature in the cooking chamber 12 constant, and after the additional heating time, automatically terminates the cooking of the food 13.

Figure 10:
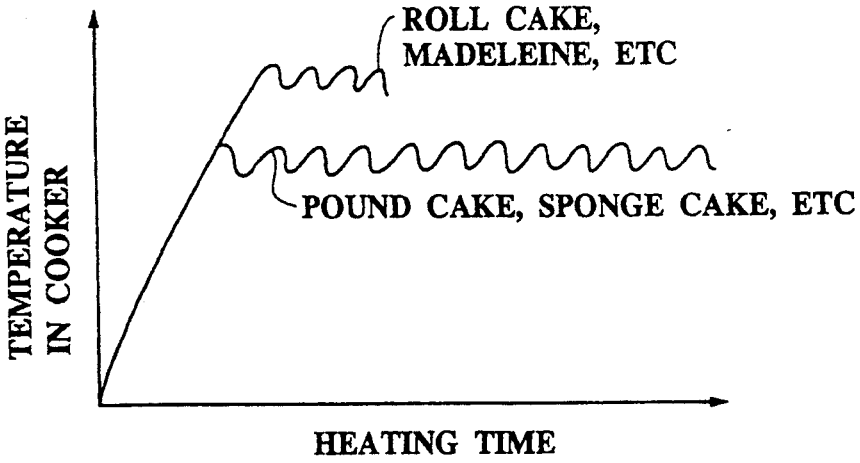
FIG. 10 is a view showing a relationship between an optimum heating temperature and an optimum cooking time for various cakes such as roll cakes and sponge cakes baked with the oven.

FIG. 10 shows a relationship between an optimum heating temperature and an optimum cooking time of various cakes such as roll cakes and sponge cakes. The sponge cake is made by pouring dough in a mold and by baking it. The dough in the mold has a small surface area and is thick. On the other hand, the roll cake is baked thin with a large surface area. Although the sponge cake and roll cake have substantially the same ingredients, the sponge cake must be baked at a lower temperature for a longer time compared with the roll cake. Repetitive tests made on madeleines and pound cakes tell that the baking conditions of the cakes depend on the surface areas of the cakes, irrespective of their ingredients which may differ from one to another.

Figure 11:
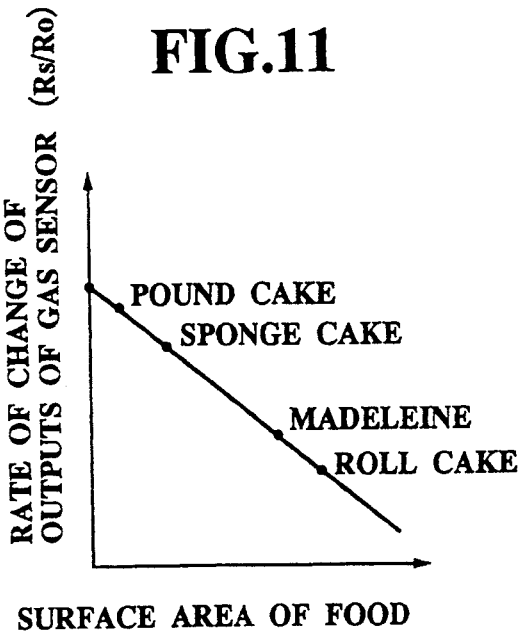
FIG. 11 is a view showing a rate of change of outputs of a gas sensor of the oven with respect to the surface area of each cake to be baked, for a range extending from the start of heating to a point where a cooking chamber of the oven attains a predetermined temperature in baking cakes such as sponge cakes with the oven.

FIG. 11 shows a rate of change of outputs of the gas sensor 9 between the start of heating and an instance when a predetermined temperature is attained in baking various cakes. In the figure, an abscissa represents the surface area of a cake, and an ordinate indicates the rate of change of outputs of the gas sensor 9. This rate is based on outputs of the gas sensor 9 measured when a temperature in the cooking chamber 12 reaches 160° C. It is understood from the figure that the rate of change of the outputs the gas sensor 9 becomes smaller as the surface area of the cake becomes larger. This means that the gas sensor 9 is temperature dependent.

Figure 12:
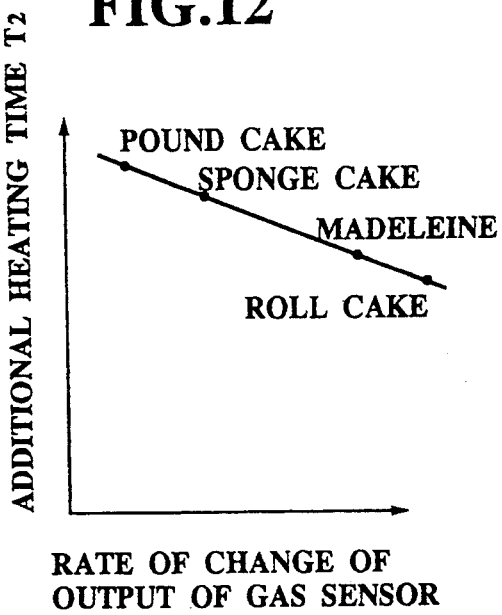
FIG. 12 is a view showing a rate of change of outputs of the gas sensor and an additional heating time after the cooking chamber has attained 160° C. in baking various cakes.

FIG. 12 shows a rate of change of outputs of the gas sensor 9 and an additional heating time after a temperature in the cooking chamber 12 reaches 160° C. in baking various cakes such as pound cakes, sponge cakes, madeleines, and roll cakes.

Figure 13:
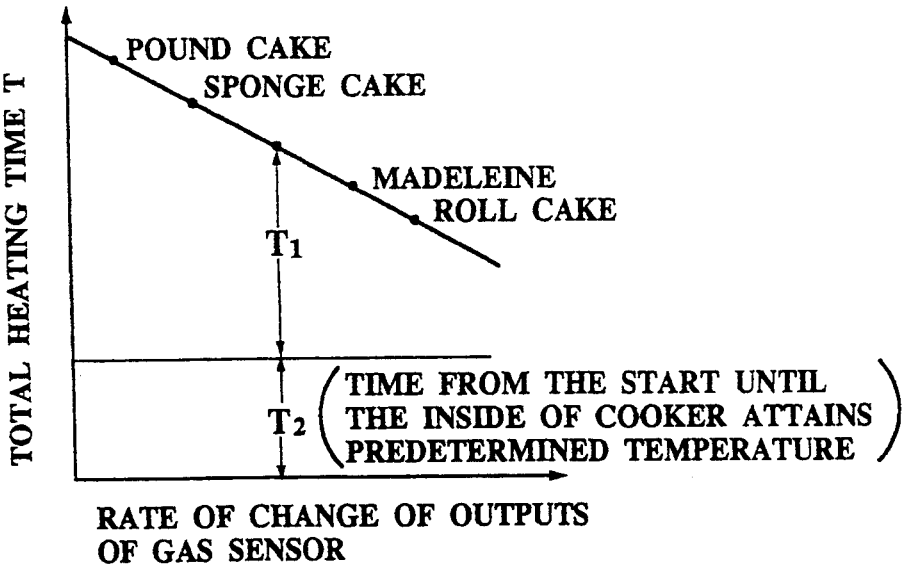
FIG. 13 is a view showing a relationship between a rate of change of outputs of the gas sensor and a total heating time in baking various cakes.

FIG. 13 is based on FIG. 12 and shows a relationship between a total heating time T and the rate of change of outputs of the gas sensor 9 in baking the various cakes such as the pound cakes, sponge cakes, madeleines, and cakes.

The cakes such as the pound cakes and sponge cakes having a small surface area must be baked at a low temperature (160° C.) in a long time, while the cakes such as madeleines and roll cakes having a large surface area mull be baked at a high temperature (180° C.) in a short time.

Figure 15:
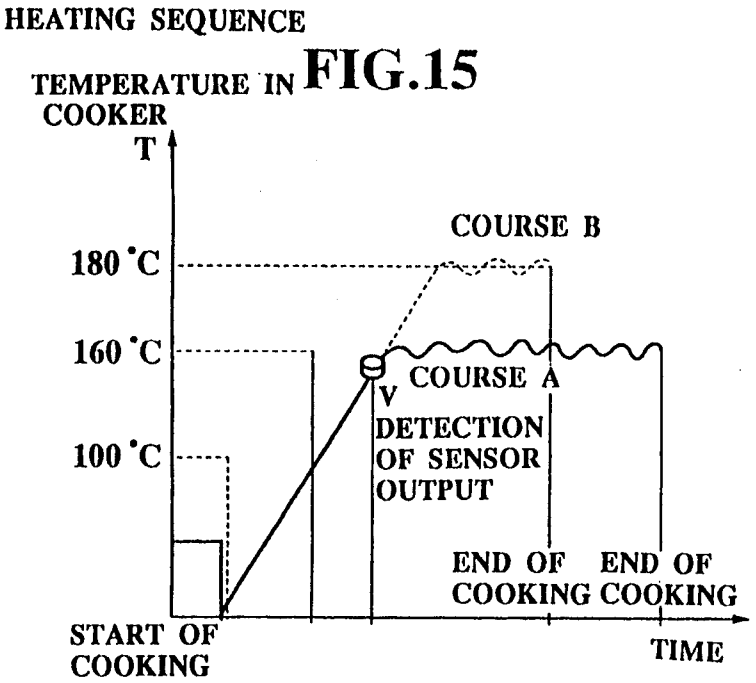
FIG. 15 is a view showing two heating sequences to be selected in the flowchart of FIG. 14.

To achieve this, the second embodiment judges, according to the rate of change of outputs of the gas sensor 9, whether or not food in the cooking chamber 12 is the pound cake or sponge cake having a small surface area or the madeleine or roll cake having a large surface area. If the food is judged to be the madeleine or roll cake having a large surface area, the temperature is further increased as shown in FIG. 15 to bake the food for a predetermined time.

Figure 14:
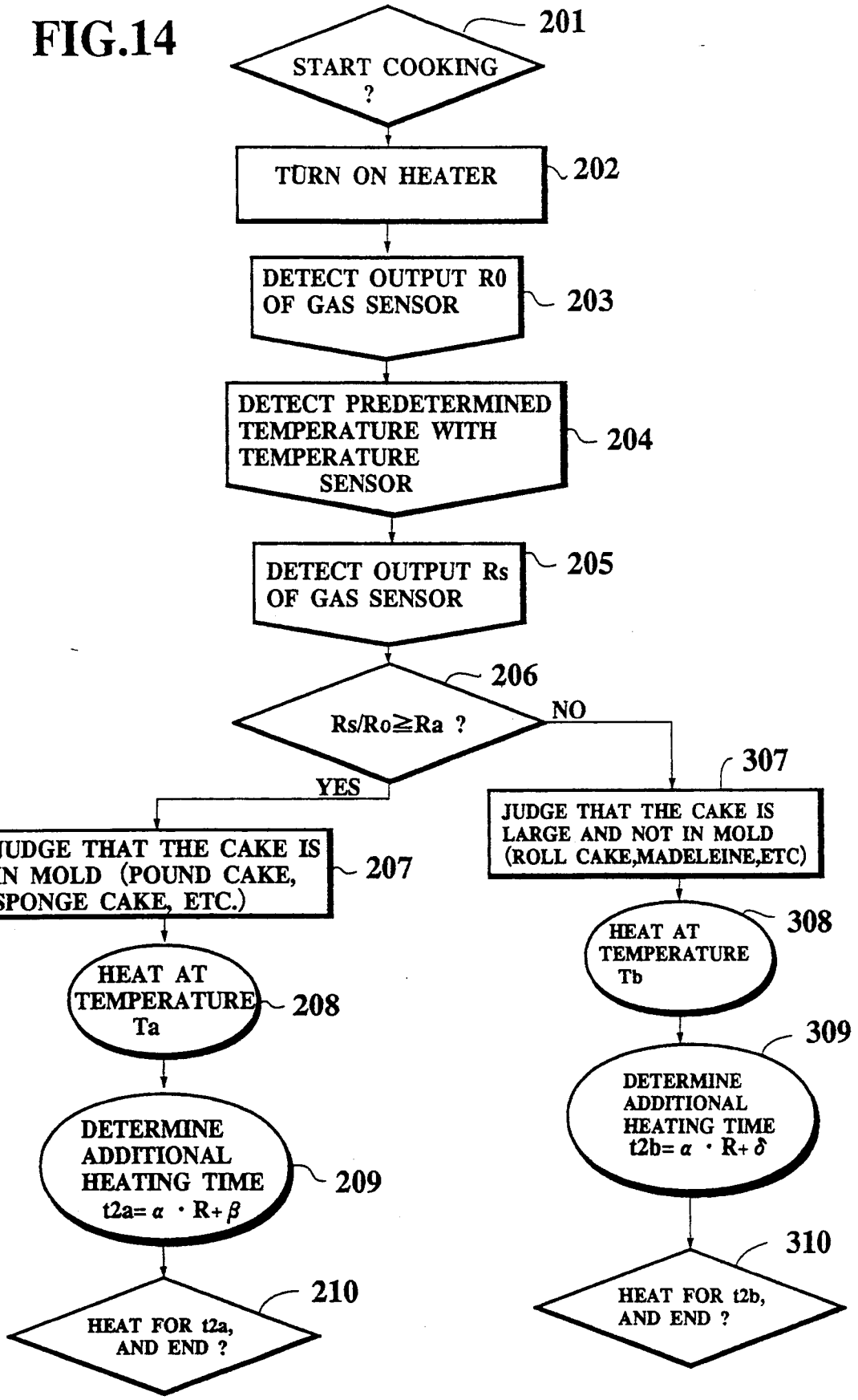
FIG. 14 is a flowchart showing an operation of the second embodiment.

Baking a cake with use of the electronic oven (heating cooker) of the second embodiment will be explained with reference to a flowchart of FIG. 14. FIG. 15 shows two heating sequences to be selected in the flowchart of FIG. 14.

Materials of the cake are kneaded and poured into a baking mold. The mold is placed in the oven. A user pushes one of the auto-keys 4 on the control panel 3 in front of the cabinet 1, and pushes a start button.

(Cooking start step 201)

As soon as the start button is pushed, the heater 7 is energized. (Energizing step 202).

The temperature sensor 10 measures a temperature TO at the energization, and the gas sensor 9 provides an output R0 (a first quantity of vapor). (Measuring steps 203 and 204)

Outputs of the temperature and gas sensors are transferred to the controller 5 through the detecting circuit 11, and stored therein as initial values.

When the temperature sensor 10 detects 160° C. after the start of heating, the gas sensor 9 provides an output Rs second quantity of vapor). (Measuring step 205)

A rate "Rs/R0" of change of outputs of the gas sensor 9 is calculated according to the value obtained when the temperature sensor 10 detected 160° C. and the value detected at the start of heating.

It is checked to see whether or not the rate Rs/R0 is greater than a predetermined value Ra. (Comparison step 206)

If it is greater than Ra, it is judged that the food is a cake having a small surface area, for example, a sponge cake or a pound cake. (Judging step 207)

Thereafter, an instruction of continuously heating the food at a heating temperature Ta is sent to the driver 6. (Instruction step 208)

At the same time, an additional heating time T2 is determined according to the rate Rs/R0. (Additional heating time determining step 209)

The additional heating time T2 is sent to the driver 6, thereby completing the cooking. (Additional heating step 210)

Figure 16:
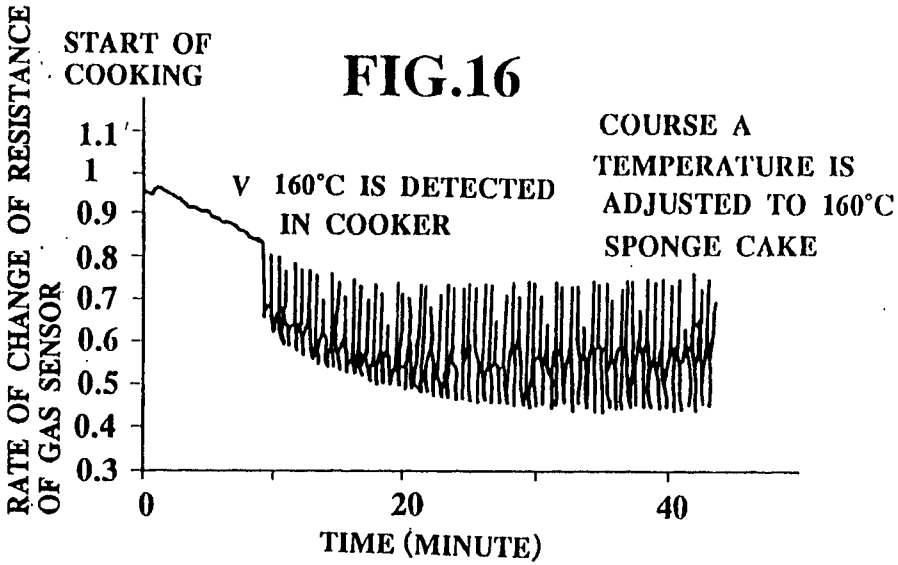
FIGS. 16 and 17 are views showing changes in resistance of the gas sensor in the two heating sequences of FIG. 15, respectively.

FIG. 16 shows a rate of change of resistance of the gas sensor 9 for the above example.

If the rate Rs/R0 is smaller than the predetermined value Ra in the comparison step 206, it is determined that the food is a cake having a large surface area, for example, a roll cake or a madeleine. (Judging step 307.)

An instruction of continuously heating the food at a heating temperature Tb is sent to the driver 6. (Instruction step 308)

At the same time, an additional heating time T2 is determined according to the rate Rs/R0. (Additional heating time determining step 309)

The additional heating time T2 is sent to the driver 6 to continuously heat the food until it is completely cooked. (Additional heating step 310)

Figure 17:
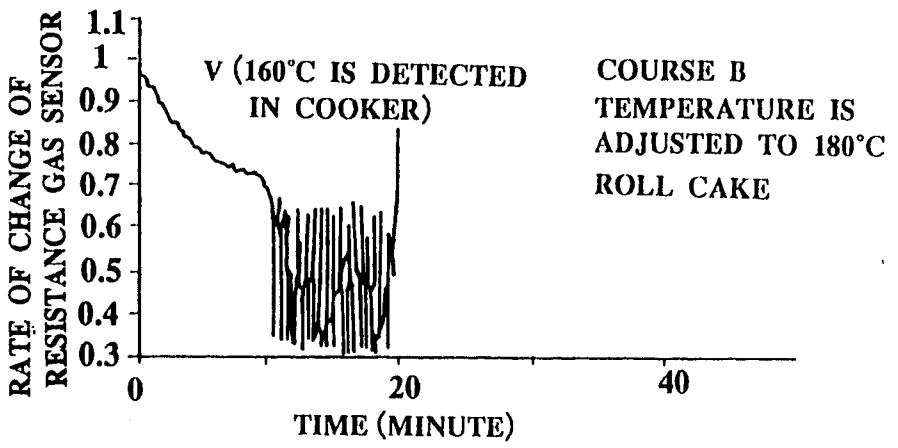

FIG. 17 shows a rate of change of resistance of the gas sensor 9 for the above example.

In this way, the cake can automatically and easily be baked under good controllability irrespective of the kind and material of a container of the cake. The cooker (electronic oven) of the second embodiment can optimally correct a heating time for different menus in cooking various menus.

The second embodiment explained above involves two kinds of cooking conditions. This invention can handle more than three kinds of cooking conditions in automatically cooking food. In this case, the temperature at which the quantity of vapor is detected may be set lower than a lowest cooking temperature.

The first and second embodiments of the invention control a cooking temperature and a cooking time of food according to an output of the gas sensor 9 provided when the predetermined temperature is attained, so that the food may precisely be controlled and cooked with one control key. Since the embodiments require no weight sensor, they improve the degree of freedom of designing and expands a space to be used for cooking in the cooker.

The third embodiment of the invention will be explained with reference to FIGS. 18 through 26.

Figure 18A:
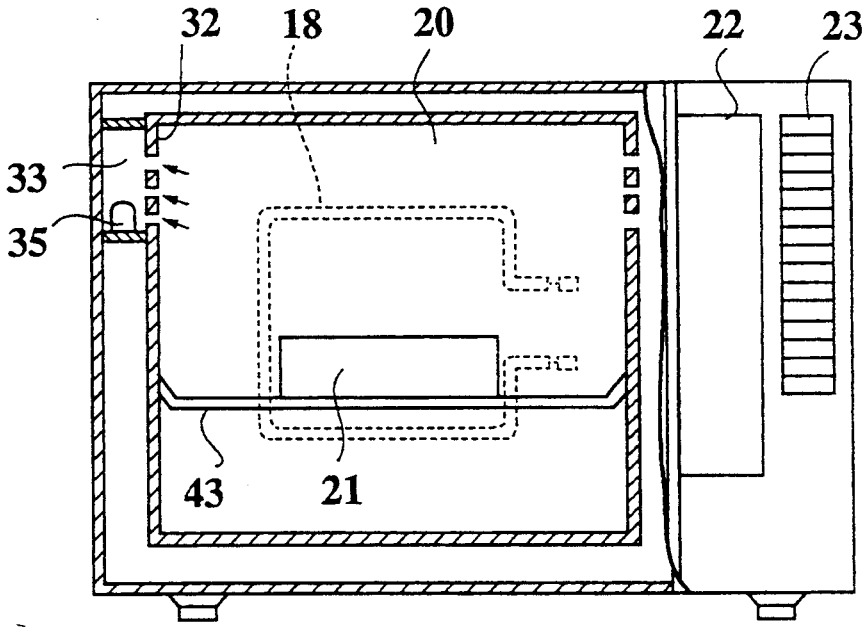
FIGS. 18*a* and 18*b* are views showing an electronic oven according to a third embodiment of the invention.
Figure 18B:
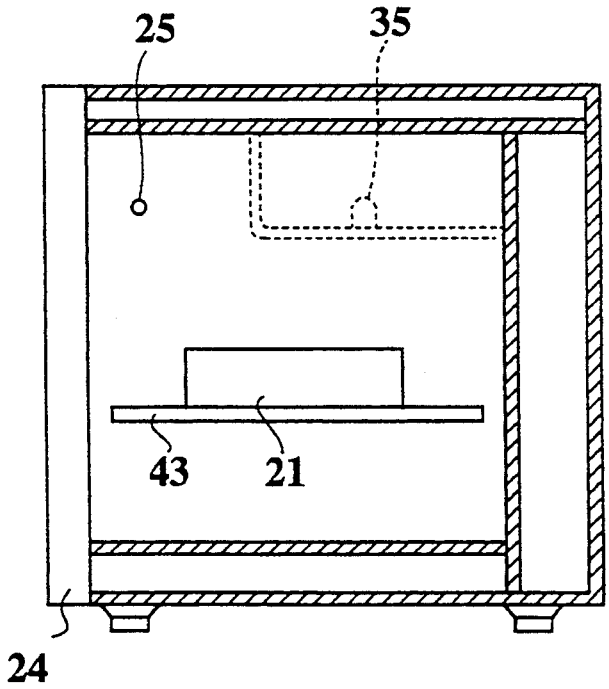

FIGS. 18*a* and 18*b* show an electronic oven (heating cooker) according to the third embodiment of the invention, in which FIG. 18*a* is a vertical section, and FIG. 18*b* is a side section. The electronic oven comprises a cooking chamber 20 for heating food 21 with a heater 18, and a vertically opening door 24. A control panel 22 is arranged on the side of the door 24. Selection keys 23 are arranged on the panel 22. A user can select and automatically cook a required menu through the keys 23.

A gas in the cooking chamber 20 is partly exhausted to an exhaust duct 33 through an exhaust port 32 and to the outside. In the exhaust duct 33, a gas sensor 35 is arranged to detect vapor or a gas. A temperature sensor 25 is arranged at an upper part of the cooking chamber 20. The exhaust duct 33 is arranged above a heating table 43 on which the food 21 is placed, so that a gas such as vapor which is lighter than air may stay at an upper part of the cooking chamber 20. This arrangement increases a concentration of the gas around the exhaust duct 33.

According to the information detected by the temperature sensor 25 and gas sensor 35, a controller (not shown) keeps a temperature inside the cooking chamber 20 constant, and automatically terminates the heating of the food 21 after the elapse of an additional heating time.

An operation of baking a cake with use of the electronic oven (heating cooker) of the third embodiment will be explained.

Figure 19:
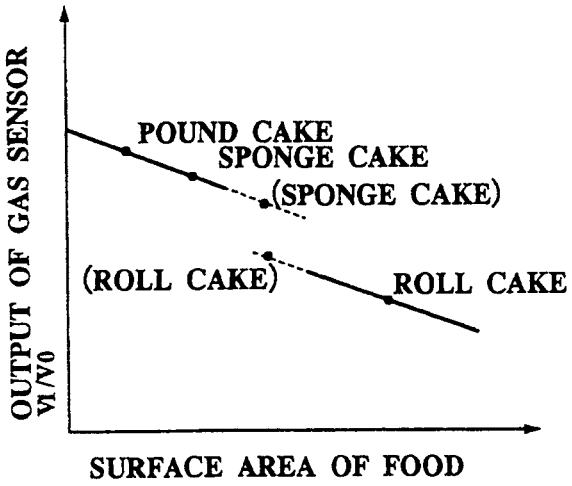
FIGS. 19 to 20 are graphs explaining the principle of the third embodiment.

FIG. 19 shows outputs of the gas sensor 35, i.e., gas concentration rates V1/V0 (V0 being a reference value) measured at a set temperature ta° C. for pound cakes, sponge cakes, madeleines, and roll cakes. To make a roll cake, dough is poured thin onto a top plate, baked, and rolled into a roll. To make a madeleine, a sponge cake, or a pound cake, dough is poured thick into a baking mold and baked. The madeleine, sponge cake, and pound cake become thinner in this order, and their surface areas decrease in the order of roll cake, madeleine, sponge cake, and pound cake. Due to the differences in the surface areas, the cakes produce vapor of different concentrations. This is the reason why the kinds of the cakes can be determined with use of the gas sensor 35.

Figure 20:
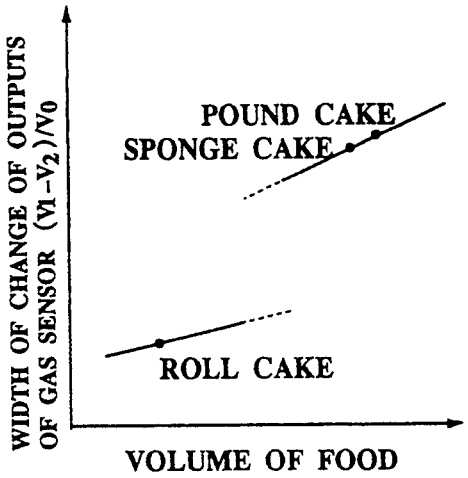

As shown in FIG. 20, a difference, i.e., the width of change of gas concentration after time Tc becomes larger as the volume of the cake increases.

Figure 21:
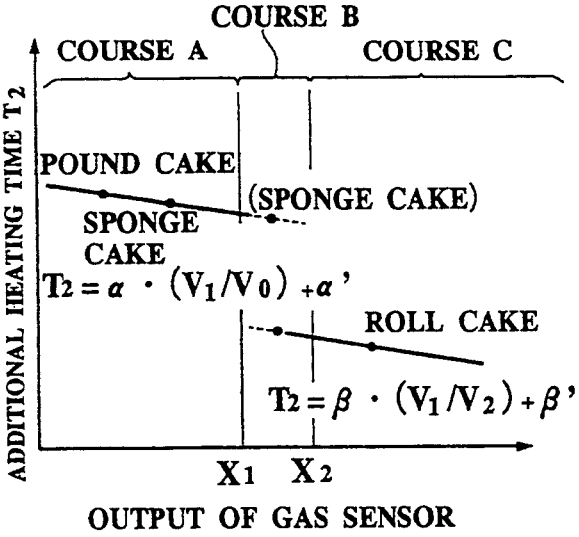
Figure 23:
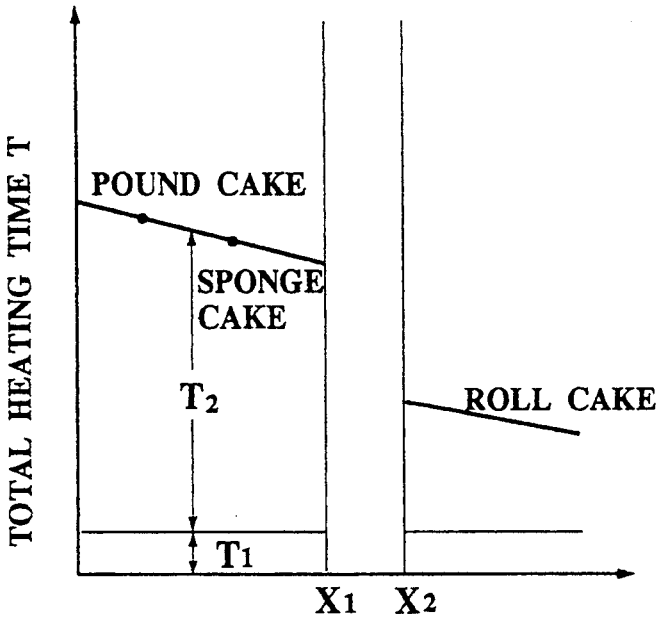

As shown in FIGS. 21 and 23, the values V1/V0 tell, to some extent, the kinds of the cakes, for example, the roll cake (course B), and the pound cake or the sponge cake (course A).

The cake such as the roll cake and madeleine having a large surface area and being thin must be baked at a high temperature in a short time. The cake such as the pound cake and sponge cake having a small surface area and being thick must be baked at a low temperature for a long time. Namely, an additional heating time T2 is determined depending on the courses A and B.

Due to a slight difference in the shapes of molds of the cakes or due to intrinsic differences of the sensor and ovens, output values of the gas sensor 35 may sometimes come on a boundary ranging from X1 to X2 between the courses A and B. In this case, it is difficult to judge whether the cake belongs to the course A or B.

Figure 22:
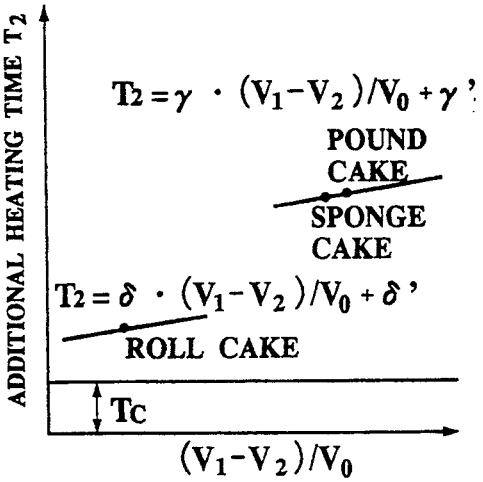
Figure 24:
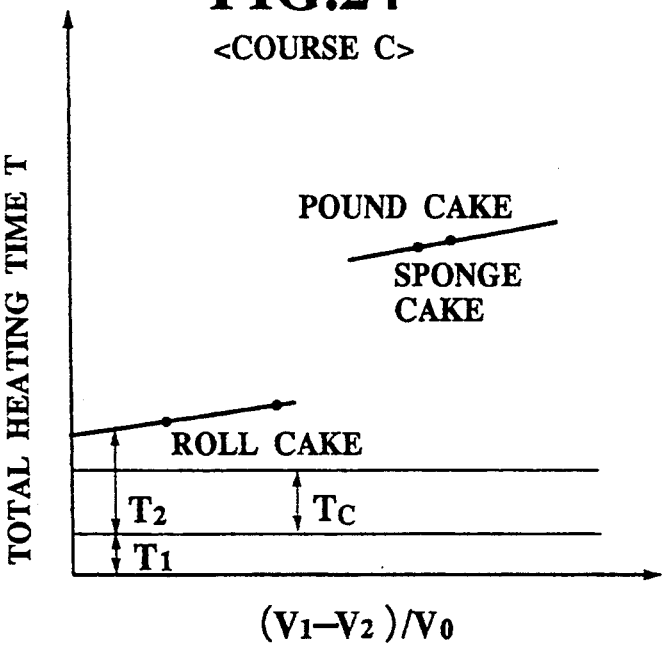

For a course C, a cake is baked at a set temperature tc for a set time Tc as shown in FIGS. 22 and 24. After the time Tc, the gas sensor 35 provides an output V2, and (V1–V2)/V0 is calculated. According to $T2=\gamma(V1-V2)/V0+\gamma'$ or $T2=\delta(V1-V2)/V0+\delta'$, an additional heating time is determined, and the heating temperature is changed to Ta or Tb. Here $\gamma$, $\gamma'$, $\delta$, and $\delta'$ are constants.

For example, a cake such as the pound cake and sponge cake having a small surface area must be baked at a low temperature (160° C.) for a long time, while a cake such as the madeleine and roll cake having a large surface area must be baked at a high temperature (180° C.) in a short time.

Based on a rate of change of outputs of the gas sensor 35, it is judged whether a cake in the cooking chamber 20 is the pound cake or sponge cake having a small surface area, or the madeleine or roll cake having a large surface area. If the cake is the madeleine or roll cake having a large surface area, the temperature is further increased and the cake is continuously baked for a predetermined time.

An object of the automatic control of the third embodiment is to correctly determine the additional heating time.

Figure 25:
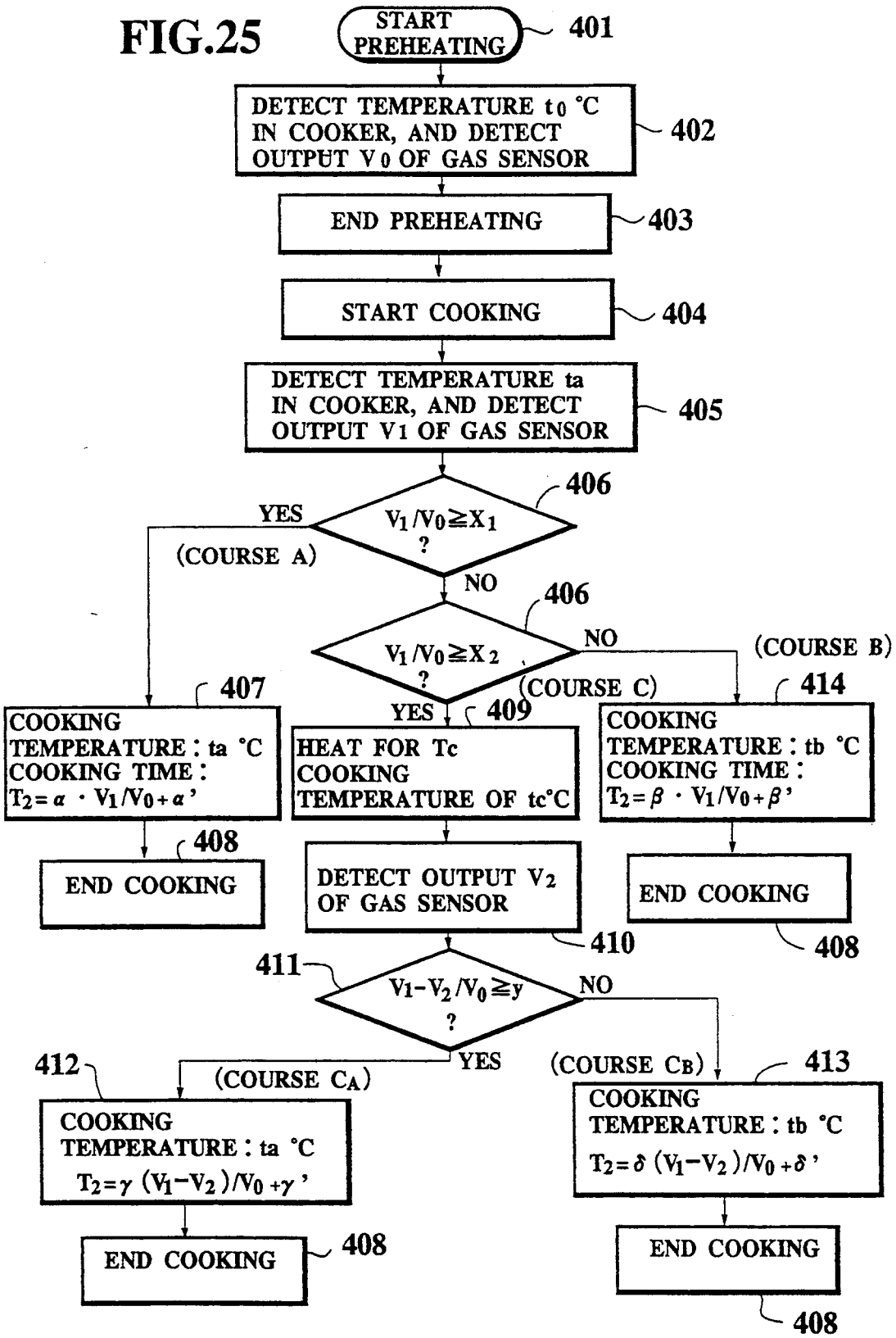
FIG. 25 is a flowchart showing an operation of baking a cake with the oven of the third embodiment.
Figure 26A:
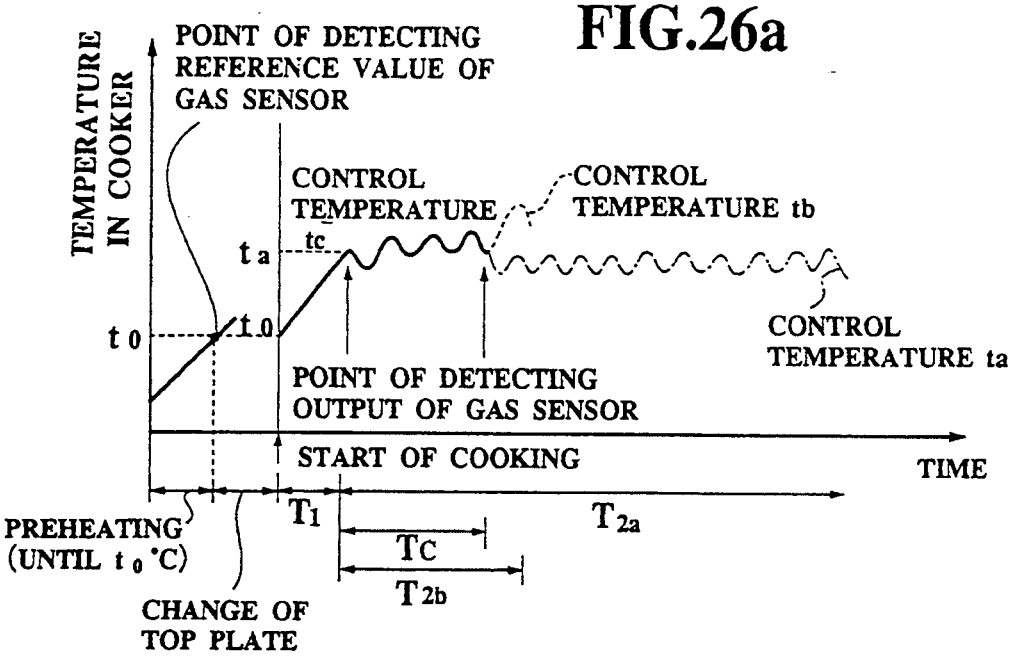
FIGS. 26*a* to 26*c* are views explaining control processes of FIG. 25.
Figure 26B:
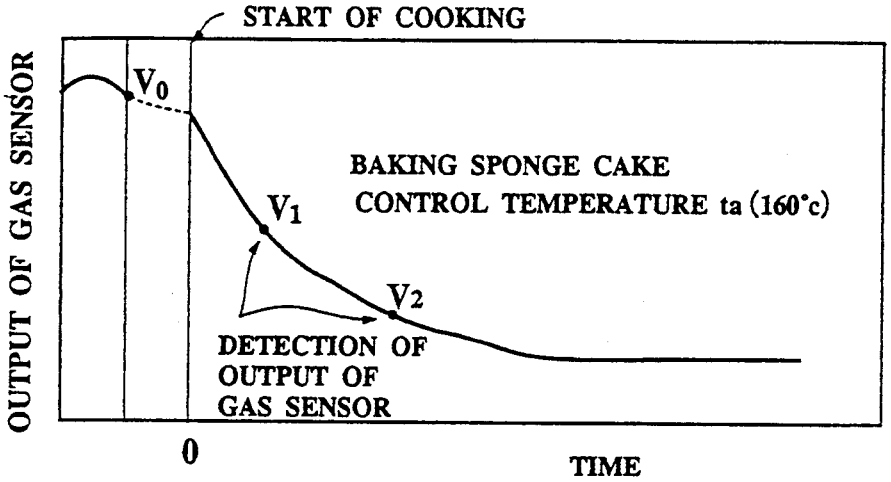
Figure 26C:
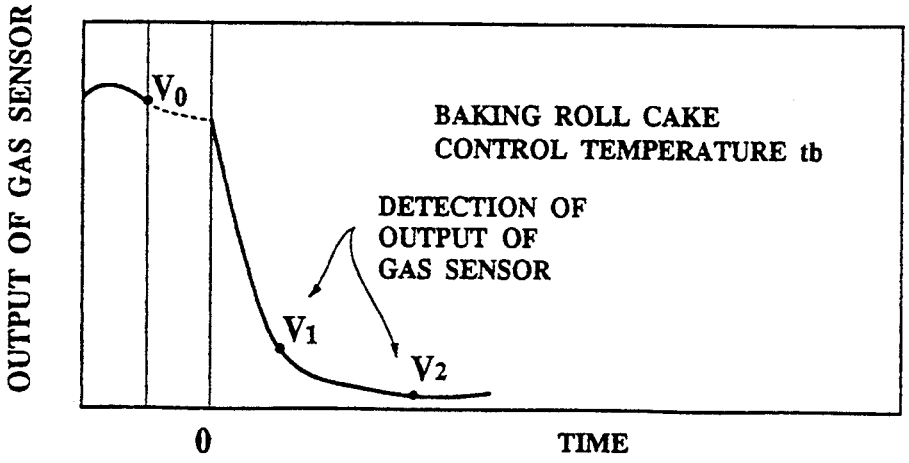

An operation of baking a sponge cake with use of the electronic oven (heating cooker) of the third embodiment will be explained with reference to a flowchart of FIG. 25 and diagrams of FIGS. 26*a* and 26*b* showing a relationship between temperature, outputs of the gas sensor 35, and time.

When one of the selection keys 23 for automatic cooking is operated, the heater 18 starts to operate to heat the cooking chamber 20 to a preheating temperature t0° C. (Preheating starting step 401)

Meanwhile, materials of, for example, a sponge cake to be baked are prepared and poured into a baking mold.

When a temperature detected by the temperature sensor reaches t0, the gas sensor 35 provides an output V0.

(Step 402)

The preheating process then ends. (Step 403)

The door of the oven is opened, and the sponge cake dough 21 with the baking mold is placed on a heating table (top plate) 43, and set in the cooking chamber 20. Thereafter, the start key is operated to restart the heater 18. (Step 404)

When a temperature detected by the temperature sensor indicates a value ta, the gas sensor 35 provides an output V1. (Step 405)

A value of V1/V0 is compared with reference values x1 and x2 to determine a course. (Judging step 406)

If $V1/V0 \geqq X1$, it is judged that the course is A for a sponge cake to start the heater 18 at a cooking temperature ta for a cooking time $T2=\alpha(V1-V2)/V0+\alpha'$. (Step 407)

The cooking then ends. (End step 408)

If $X2 \geqq V1/V0 < X1$ in the judging step 406, it is judged that the course is C, and the cake is heated at a set temperature to for a set time Tc. (Step 409)

After the elapse of the time Tc, the gas sensor 35 provides an output V2. (Step 410)

Based on V2, (V1–V2)/V0 is calculated and judged whether or not it is larger than a value y. (Judging step 411)

If it is judged that $(V1-V2)/V0 \geqq y$, the cake is additionally heated at a cooking temperature ta for a time $T2=\gamma(V1-V2)/V0+\delta'$. (Step 412)

The cooking then ends. (End step 408)

If it is judged that $(V1-V2)/V0 < y$ in the judging step 411, the cake is additionally heated at a cooking temperature tb for a time $T2=\delta(V1-V2)/V0+\delta'$. (Step 413)

The cooking then ends. (End step 408)

If it is $V1/V0 < X2$ in the judging step 406, it is judged that the course is B for a roll cake, and the heater 18 is operated at a cooking temperature tb for a cooking time $T2=\beta(V1-V2)/V0+\beta'$. (Step 414)

The cooking then ends. (End step 408)

In this way, heating conditions are determined more precisely according to both the gas concentration and its rate of change so that the cake may easily automatically be baked under good controllability irrespective of the kind and material of a controllability irrespective of the kind and material of a container of the cake. The cooker (electronic oven) of the third embodiment can optimally correct a heating time for different menus to cook various menus.

The above embodiment relates to the grilling function of the cooker (electronic oven). This invention is applicable also for an oven function for circulating hot air with a fan. In this case, before measuring the quantity of vapor, the fan is stopped to keep the vapor around the gas sensor. Thereafter, the quantity of vapor is measured. This realizes precise measurement of the quantity of vapor.

As explained above, the third embodiment involves two kinds of conditions to be set. This invention can handle more than three kinds of conditions for automatically cooking food.

The third embodiment has been explained with reference to the automatic cooking of cakes. The present invention is not limited to the cakes but applicable for baking various kinds of bread having different surface areas and sizes, as well as other dishes.

The gas sensor of the electronic oven (heating cooker) may commonly be used for achieving the oven function.

As explained above, the heating cooker according to the third embodiment of the invention comprises the gas sensor for detecting a gas produced from a cake. According to the detected quantity of the gas, the kind of the cake is determined to automatically set a heating temperature and a heating time, based on which the cake is baked. The concentration of a gas or vapor evaporating from the cake during baking and a change in the concentration of the gas are detected to judge the kind of the cake. According to a result of the judgment, the heater is controlled. In this way, the present invention realizes precise judgment of the cake, sufficiently controls the baking of the cake at high precision depending on the kind of the cake.

Various modifications will become possible for those skilled in the art after receiving the teachings of the present disclosure without departing from the scope thereof.

What is claimed is:

1. A heating cooker comprising:

(a) a cooking chamber having a heater for heating an object;

(b) a gas sensor located in said cooking chamber for detecting gas or vapor evaporating from the object being heated in said cooking chamber, said gas sensor producing an output which is indicative of a quantity of gas or vapor evaporating from the object being heated;

(c) a temperature sensor molted proximate to said gas sensor for detecting a temperature around said gas sensor in said cooking chamber; and (d) control means for controlling electric supply to said heater, said control means 1) measuring a first output (V0) of said gas sensor at a start of cooking, 2) measuring a second output (V1) of said gas sensor after the inside of said cooking chamber attains a set temperature which is lower than a lowest cooking temperature specifically associated with the object being heated, 3) adjusting said electric supply to heat the object at a temperature (t2) for a set time, 4) thereafter measuring a third output value (V2) of said gas sensor, 5) determining a kind of the object based on the first and second outputs (V0 and V1) 6) adjusting said electric supply to heat the object at a cooking temperature and for a cooking time which are each calculated based on the first, second, and third output values (V0, V1, and v2).

2. The heating cooker according to claim 1, wherein the temperature in said cooking chamber at the start of cooking is a room temperature.

3. The heating cooker according to claim 1, wherein the temperature in said cooking chamber at the start of cooking is a temperature attained after preheating.

4. The heating cooker according to claim 1, wherein the food is one of a bread and a cake.

5. A heating cooker comprising:

(a) a cooking chamber in which a food is placed for cooking;

(b) a heater provided in said chamber for heating said food;

(c) a gas sensor provided in said chamber for detecting a quantity of vapor in said chamber during cooking of said food;

(d) a temperature sensor located proximate to said gas sensor and provided in said chamber for detecting a temperature around said gas sensor in said chamber; and (e) control means operatively connected to said temperature sensor, said gas sensor and said heater, for determining a kind of the food based on outputs of said gas sensor and said temperature sensor, and for controlling operation of said heater in accordance with the kind of the food, wherein said control means receives a detected temperature in said chamber at a start of cooking and corrects the quantity of vapor detected by said gas sensor based on the detected temperature in said chamber at the start of cooking.

6. The heating cooker according to claim 5, wherein the temperature in said cooking chamber at the start of cooking is a room temperature.

7. The heating cooker according to claim 5, wherein the temperature in said cooking chamber at the start of cooking is a temperature attained after preheating.

8. The heating cooker according to claim 5, wherein the food is one of a bread and a cake.

9. The heating cooker according to claim 8, wherein the heating cooker is an electronic oven.

10. A heating cooker comprising:

(a) a cooking chamber in which a good is placed for cooking;

(b) a heater provided in said chamber for heating said food;

(c) a gas sensor provided in said chamber for detecting a quantity of vapor occurring in said chamber during cooking of said food;

(d) a temperature sensor provided in said chamber and located proximate to said gas sensor for detecting a temperature around said gas sensor in said chamber; and (e) control means operatively connected to said temperature sensor, said gas sensor and said heater, for determining a kind of the food based on outputs of said gas sensor and said temperature sensor and for controlling operation of said heater in accordance with the kind of the food, wherein said control means controls said heater to start cooking said food, controls said gas sensor to detect the quantity of vapor at first and second outputs of said gas sensor which are obtained at said first and second points in time, respectively.

* * * * *